US008726512B2

(12) United States Patent
Zahner, III et al.

(10) Patent No.: US 8,726,512 B2
(45) Date of Patent: May 20, 2014

(54) METAL BUILDING PANEL AND METHOD OF MAKING SAME

(75) Inventors: L. William Zahner, III, Kansas City, MO (US); Reilly Hoffman, Kansas City, MO (US)

(73) Assignee: A. Zahner Company, Kansas City, MO (US)

( * ) Notice: Subject to any disclaimer, the term of this patent is extended or adjusted under 35 U.S.C. 154(b) by 1118 days.

(21) Appl. No.: 12/394,123

(22) Filed: Feb. 27, 2009

(65) Prior Publication Data

US 2010/0218363 A1 Sep. 2, 2010

(51) Int. Cl.
*B29C 33/38* (2006.01)

(52) U.S. Cl.
USPC ..... 29/897.32; 29/897.3; 29/527.2

(58) Field of Classification Search
USPC ..... 29/897.32, 897.3, 897.312; 205/531, 205/150, 80
See application file for complete search history.

(56) References Cited

U.S. PATENT DOCUMENTS 3,982,314 A * 9/1976 Ariga et al. ..... 29/527.4
5,453,173 A * 9/1995 Oyama ..... 205/70
2006/0222882 A1 * 10/2006 Honda et al. ..... 428/659

* cited by examiner

*Primary Examiner* — David Bryant
*Assistant Examiner* — Christopher Besler
(74) *Attorney, Agent, or Firm* — Hovey Williams LLP

(57) ABSTRACT

A contoured metal building panel comprising an inner layer formed from a piece of flexible material that has been manipulated to create contours along its surface and an outer coating that substantially encases and hardens the flexible material so that the contours are substantially rigid and fixed.

9 Claims, 5 Drawing Sheets

METAL BUILDING PANEL AND METHOD OF MAKING SAME

BACKGROUND

The present invention relates to metal building panels. More particularly, the invention relates to a highly contoured metal building panel and a method of making the same.

Metal building panels are frequently used as exterior cladding for building walls and roof structures. Architects and builders of contemporary buildings and other works of architecture often use metal building panels that have been designed to achieve particular aesthetic qualities. For example, such panels are often bent or otherwise formed into complex shapes and curves to achieve a particular appearance. Similarly, the surfaces of metal building panels are often subjected to chemical and mechanical finishes and/or textures to achieve desired light reflectivity, coloring, and texture. However, because metal building panels are typically rigid and hard, there is a limit to the amount they may be bent, shaped, textured, etc. and therefore a limit to the design of buildings and other structures clad with the panels.

SUMMARY

The present invention provides an improved metal building panel and method of making the same. More particularly, embodiments of the present invention provide a metal building panel with dramatic contours that cannot be created with conventional metal bending, finishing, and texturing techniques.

One embodiment of the invention is a method of forming a contoured metal building panel comprising the steps of manually manipulating a piece of flexible screen-like material to create contours in the material; securing edges of the flexible material so as to substantially maintain the contours in the material; dipping or otherwise exposing the flexible material to a molten metal such as molten zinc; and allowing the flexible material and the molten metal which adheres to it to cool and harden to form a rigid panel with dramatic contours. The flexible material may be any material that can be manipulated by a person into a desired shape and that retains its shape. For example, the flexible material may be fiberglass screen material, aluminum screen wire material, copper screen wire material, bronze screen wire material, stainless steel screen wire material, or galvanized steel screen wire material.

Another embodiment of the invention is a contoured metal building panel comprising an inner layer formed from a piece of flexible material that has been manipulated to create contours along its surface and an outer coating that substantially encases and hardens the flexible material so that the contours become substantially fixed. Again, the flexible material may be any material that can be manipulated by a person into a desired shape and that retains its shape. For example, the flexible material may be fiberglass screen material, aluminum screen wire material, copper screen wire material, bronze screen wire material, stainless steel screen wire material, or galvanized steel screen wire material.

These and other important aspects of the present invention are described more fully in the detailed description below.

BRIEF DESCRIPTION OF THE DRAWING FIGURES

Embodiments of the present invention are described in detail below with reference to the attached drawing figures, wherein.

Figure 2:
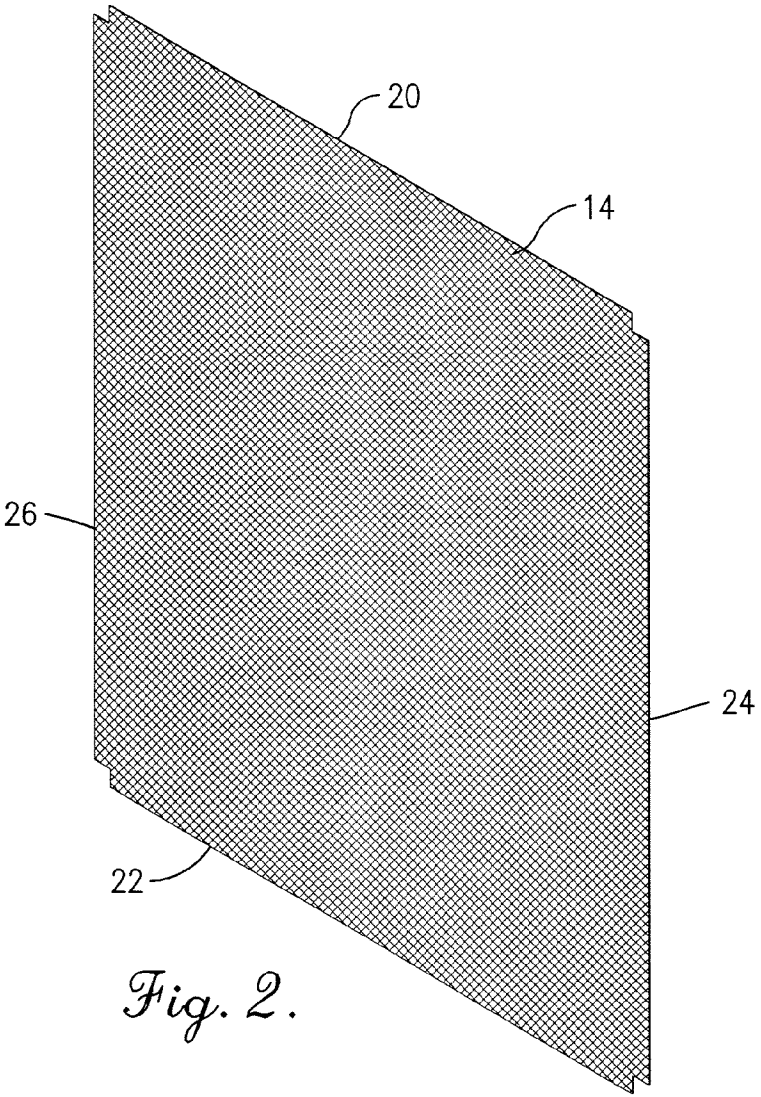
FIG. 2 is a perspective view of a piece of flexible material before it has been bent or otherwise shaped in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the present invention is defined only by the appended claims, along with the full scope of equivalents to which such claims are entitled.

Figure 1:
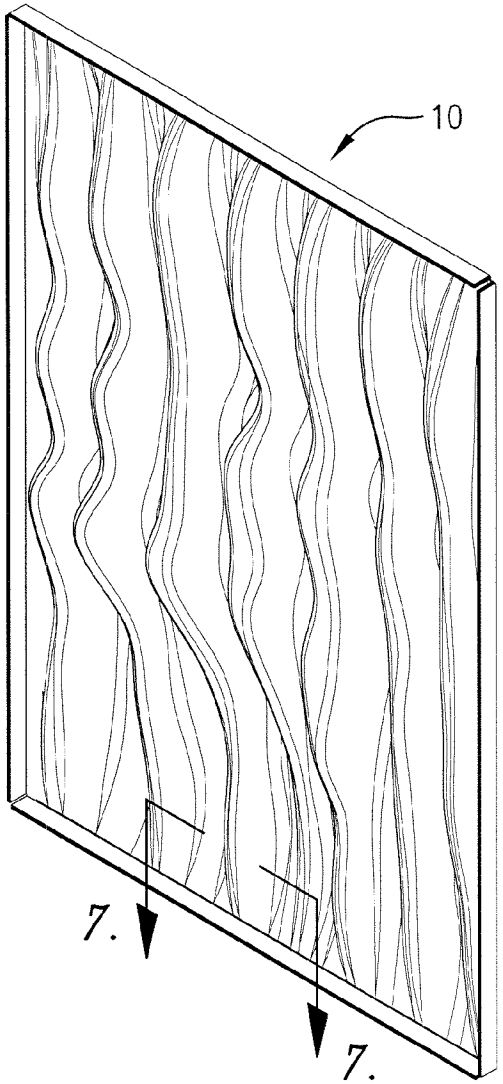
FIG. 1 is a perspective view of a contoured metal building panel constructed in accordance with an embodiment of the present invention.
Figure 8:
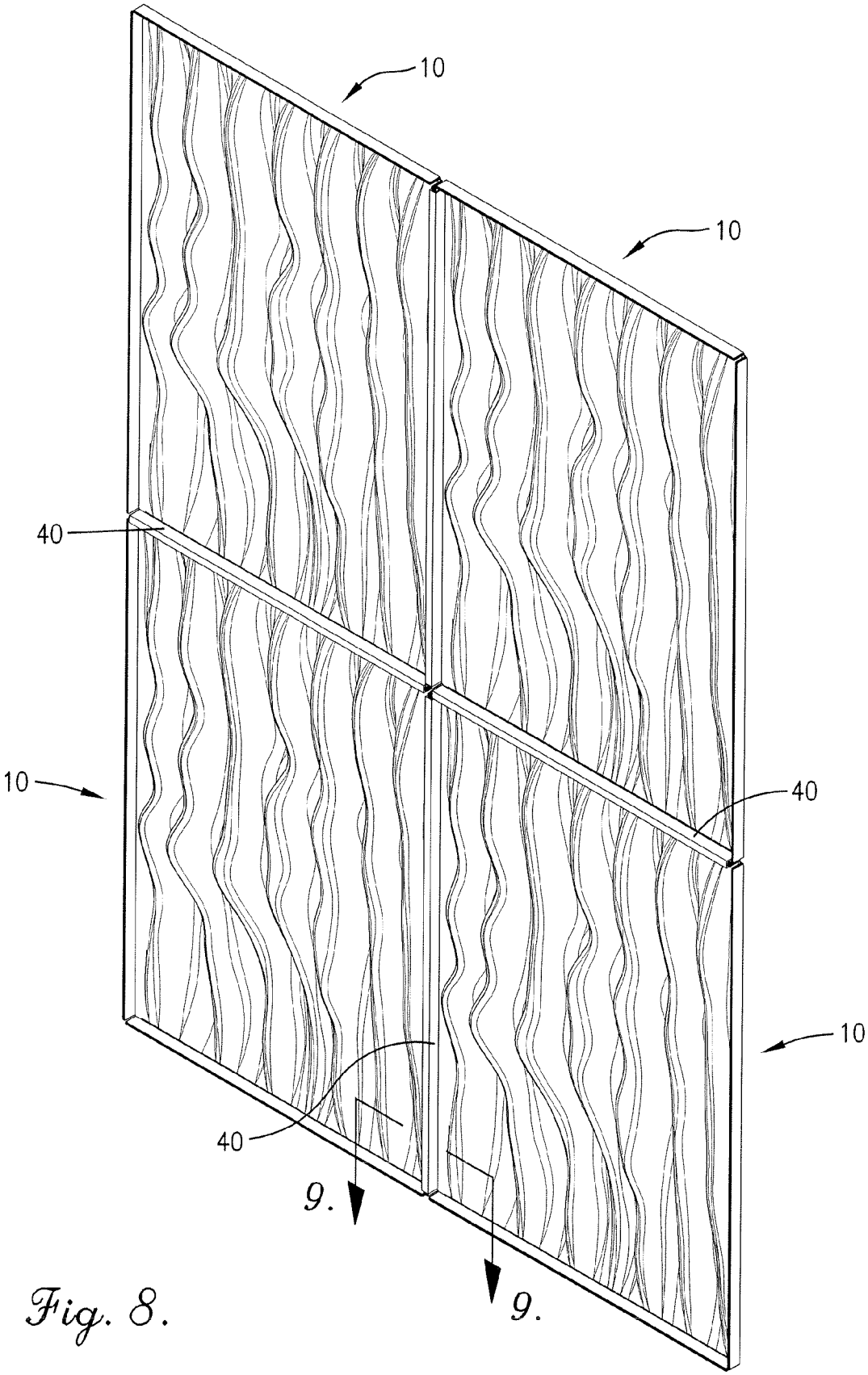
FIG. 8 is a perspective view of several contoured metal building panels shown attached together for placement on a building or other structure.

Turning now to the drawing figures, and initially FIG. 1, a contoured metal building panel 10 constructed in accordance with an embodiment of the invention is illustrated. Any number of the contoured metal building panels 10 may be joined as shown in FIG. 8 and used as exterior or interior cladding of a building or other structure or work of architecture. The particular peripheral shape of the contoured metal building panel 10 may vary and depends upon the application. For example, the contoured metal building panel may be substantially rectangular as shown but may also be circular, oval, oblong, or any other shape. Similarly, the contoured metal building panel may be of any size depending on its application. The maximum size of the panel may be limited by practical limitations such as weight limits, equipment size limits, shipping constraints, etc. In an exemplary embodiment, each contoured metal building pane 10 may be 1-5' wide, 2-10' long, and 0.1-0.5" thick.

As best illustrated in FIGS. 1, 2, 3, and 7, an exemplary embodiment of the contoured metal building panel 10 includes an inner layer 12 formed from a piece of flexible material 14 that has been manipulated to create contours 16 along its surface and an outer coating 18 that substantially encases and hardens the inner layer 12 so that the contours 16 become substantially fixed and rigid.

In more detail, the inner layer 12 may be formed of any material that can be easily bent, folded, wadded, creased, or otherwise shaped or manipulated to create desired contours 16 along the surface thereof and that substantially retains its shape after such manipulation. In exemplary embodiments, the inner layer is formed from a piece of flexible material 14 such as fiberglass screen material, aluminum screen wire material, copper screen wire material, bronze screen wire material, stainless steel screen wire material, or galvanized steel screen wire material. In a particular embodiment, the inner layer 12 is formed from aluminum screen wire material with 20×20 holes per square inch and 0.01-0.015 inch diameter aluminum fibers.

Figure 3:
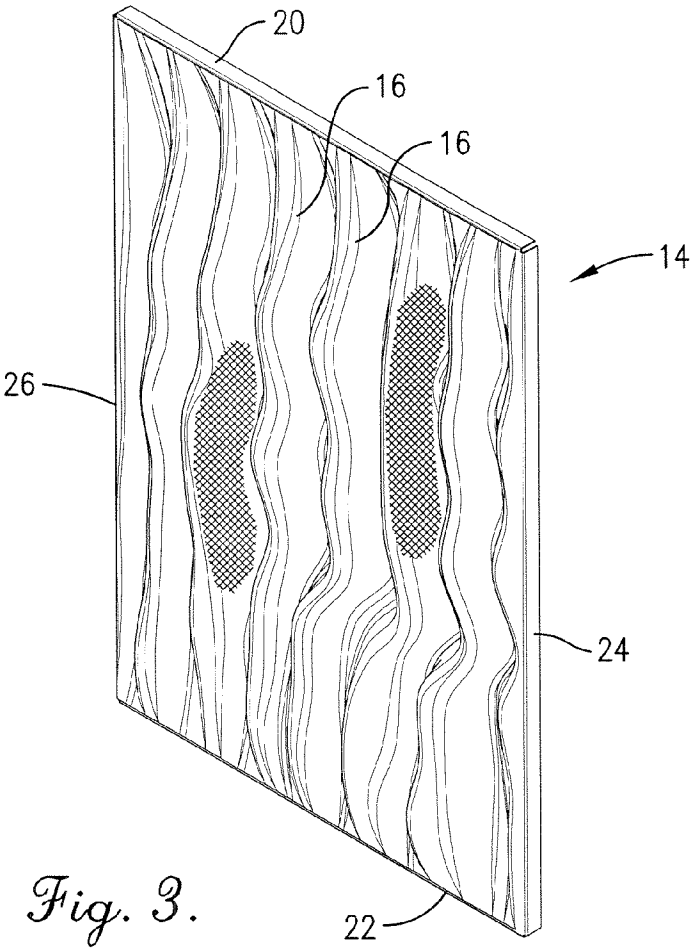
FIG. 3 is a perspective view of the piece of flexible material of FIG. 1 after it has been bent, shaped, or otherwise contoured in accordance with an embodiment of the invention, with portions shown shaded for clarity.
Figure 6:
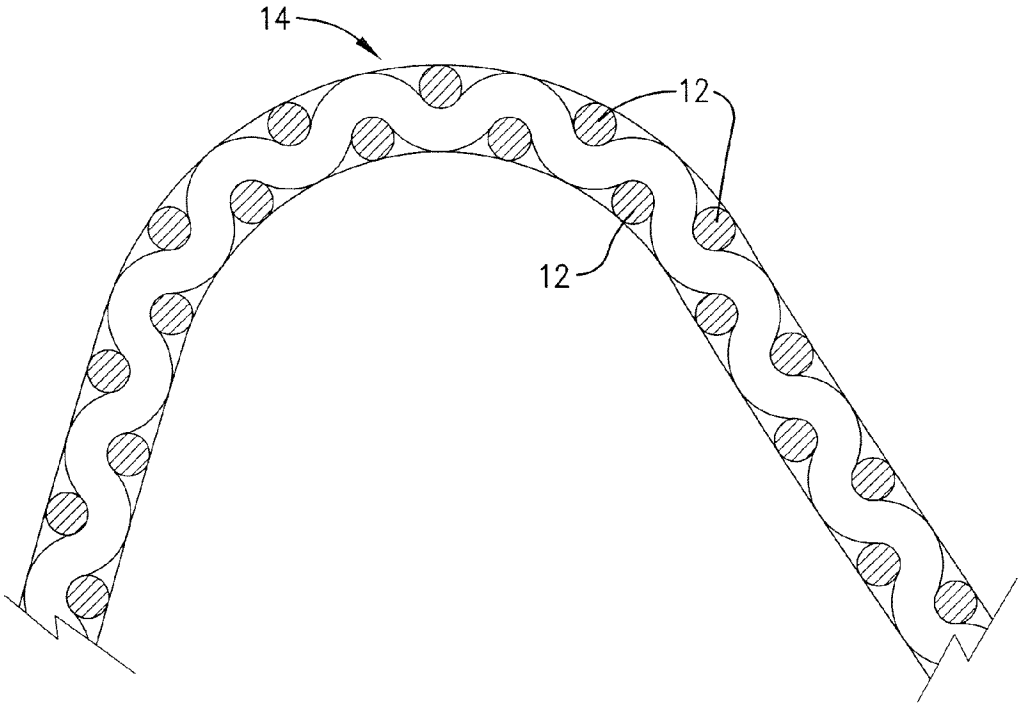
FIG. 6 is a horizontal sectional view of the flexible material taken along line 6-6 of FIG. 4.

An important aspect of the invention is that an artist, architect, designer, or other person may manually shape the flexible material 14 in limitless different ways to achieve any desired appearance. By way of example only, the flexible material 14 may be shaped so as to create a number of spaced-apart undulating contours 16 that extend roughly parallel to a longitudinal axis of the finished contoured metal building panel as shown in FIG. 3. Alternatively, the flexible material 14 may be shaped to create contours that extend perpendicular to the longitudinal axis of the panel 10 or at an angle relative to the longitudinal axis. The contours may also be irregular and/or random in appearance. The particular size, shape, appearance, and arrangement of the contours is only limited by the artist's or other person's imagination.

Figure 4:
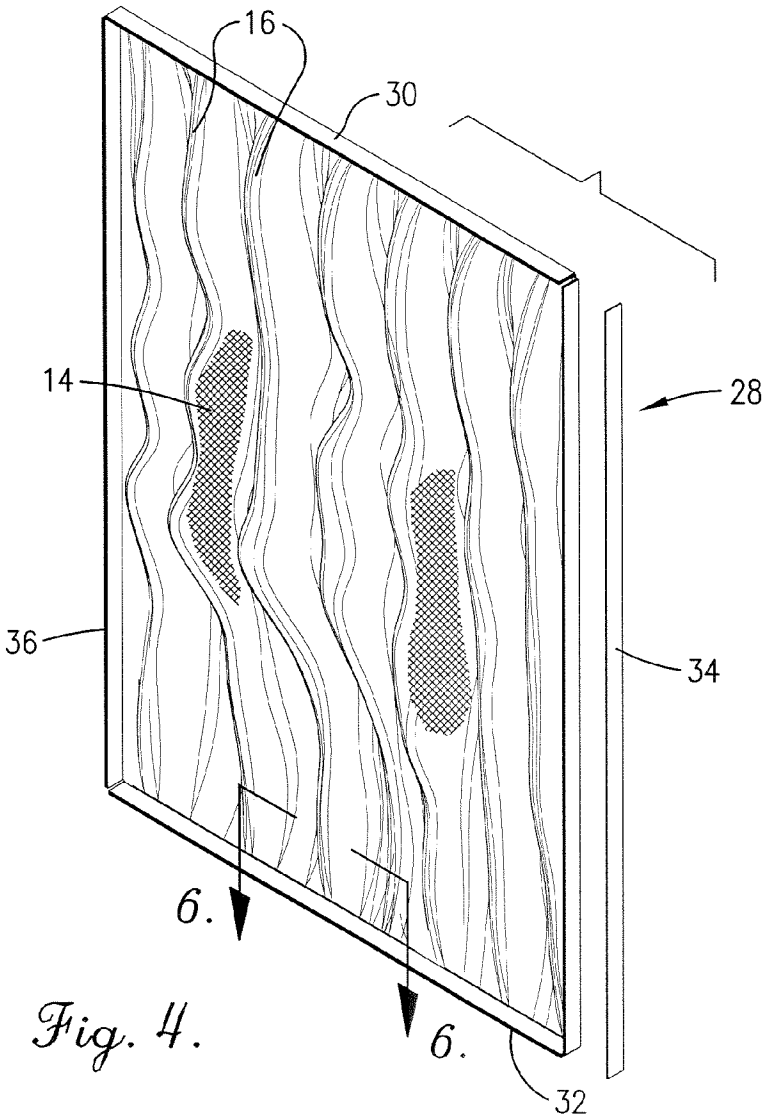
FIG. 4 is a perspective view of the piece of flexible material and a retainer that maintains the contours in the flexible material.

In order to maintain the contours 16 in the flexible material 14, its top, bottom, and side edges 20, 22, 24, 26 may be bent inward approximately 90° as shown in FIG. 3 and then secured by a retainer 28. An exemplary embodiment of the retainer 28 is shown in FIG. 4 and includes four metal strips 30, 32, 34, 36 that together form a frame-like structure that encloses the edges 20, 22, 24, 26 of the flexible material. The sides may be formed of metal or any other suitable material and in one embodiment extend perpendicularly to the plane of the flexible material. The sides thus form a continuous or semi-continuous flange extending perpendicularly from one face of the flexible material, the purpose of which is described below.

The outer coating 18 substantially encases the inner layer 12 and makes the contoured metal building panel 10 substantially water-impervious. The outer coating may be formed of any material that can be easily applied to the flexible material 14 and dries or hardens to become rigid and relatively impervious. In some embodiments, the outer coating is zinc, a zinc alloy, or other metal that can be readily melted and then hardened as discussed below.

FIGS. 2-5 schematically illustrate a method for forming the contoured metal building panel 10 described above. The drawings figures are for illustrative purposes only, are not necessarily to scale, and do not limit the method to the particular embodiments shown.

The method begins with a piece of flexible material 14, such as the one shown in FIG. 2. As mentioned above, the flexible material becomes the inner layer 12 of the contoured metal building panel 10. The flexible material may be any material that can be manually manipulated into a desired shape and that retains its shape, such as fiberglass screen material, aluminum screen wire material, copper screen wire material, bronze screen wire material, stainless steel screen wire material, or galvanized steel screen wire material. The flexible material may also be of any desired peripheral size and shape.

An artist, architect, designer, or other person then manually manipulates the flexible material 14 to create contours 16 in its surface, as shown in FIG. 3. As mentioned above, the flexible material may be manipulated or otherwise shaped to created contours of any shape, size, and pattern. To more clearly illustrate the contours 16, only a portion of FIG. 3 shows the mesh or other pattern of the flexible material 14.

Once the contours 16 have been formed in the flexible material 14, the flexible material may be secured to prevent or at least minimize movement of the contours during subsequent steps of the method. In one embodiment, this is done by securing the edges of the flexible material in a frame-like retainer 28 such as the one illustrated in FIG. 4.

Figure 5:
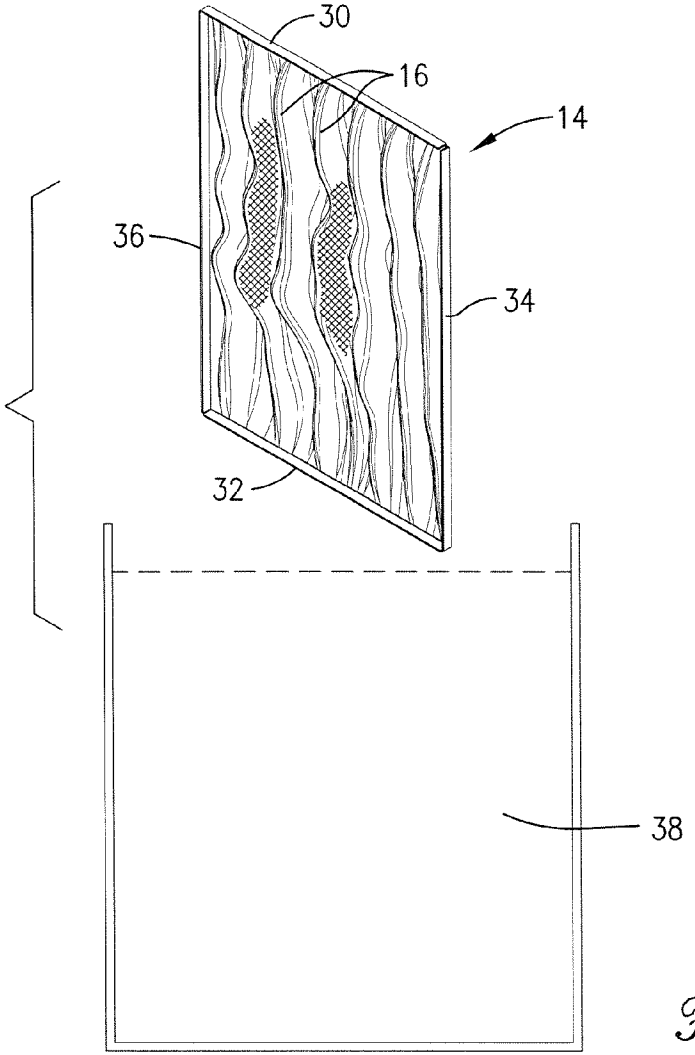
FIG. 5 is a perspective view of the piece of flexible material being dipped or otherwise exposed to molten metal.
Figure 7:
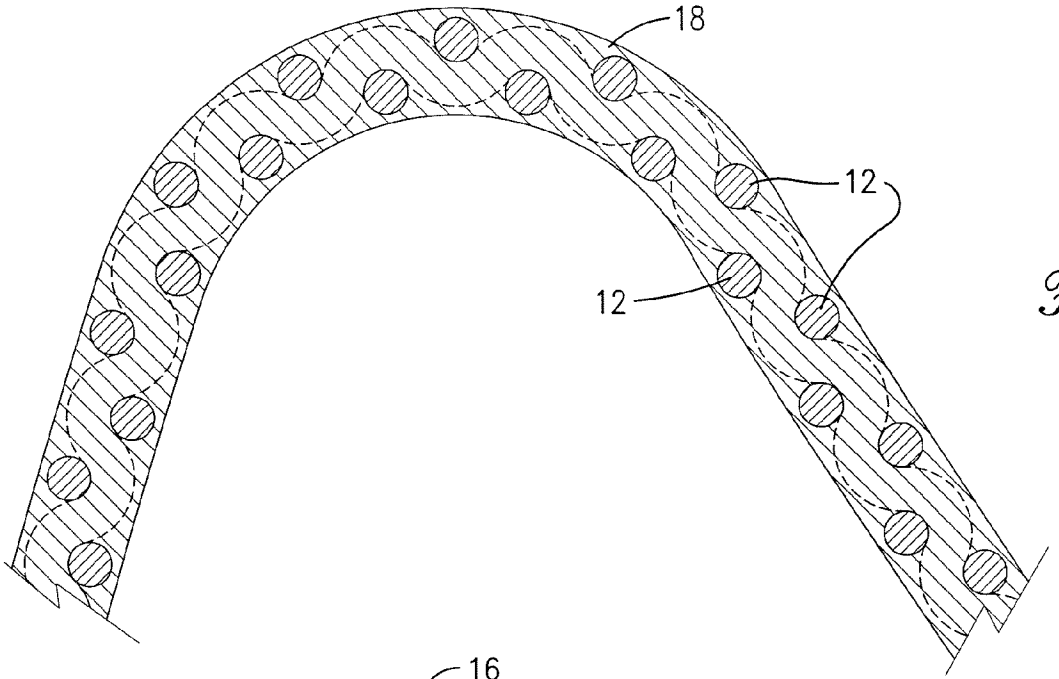
FIG. 7 is a horizontal sectional view of the contoured metal building panel taken along line 7-7 of FIG. 1.

Molten metal is then applied to the flexible material 14 to form the outer coating 18 of the contoured metal building panel 10. In one embodiment, this is done by dipping or otherwise passing the contoured flexible material through a molten bath of zinc 38 as depicted in FIG. 5. The zinc may be applied in a continuous hot-dip galvanizing line, in a batch galvanizing process, in an electrogalvanizing process, or any other zinc application process.

Because molten zinc is relatively heavy and the flexible material 14 is relatively thin and flimsy, the zinc may cause the contours 16 in the flexible material 14 to flatten or otherwise move when the flexible material is dipped in the zinc 38. Applicant has discovered that this flattening phenomenon can be eliminated or at least largely reduced by selectively orienting the flexible material 14 relative to the zinc 38 during the dipping step. Applicant has also discovered that the ideal orientation of the flexible material 14 relative to the molten zinc 38 depends on the arrangement and/or direction of the contours 16 in the flexible material. For example, if the contours 16 primarily consist of undulating and alternating ridges and valleys that extend generally parallel to a longitudinal axis of the contoured metal building panel as shown in the drawing figures, the contours 16 are best maintained if the flexible material 14 is oriented in an upright position so that its lower edge 22 and retainer portion 32 first contact the molten zinc 38. This reduces the tendency of the zinc to flatten the longitudinally extending contours. Alternatively, if the contours primarily consist of ridges and valleys that extend generally perpendicular to the longitudinal axis of the contoured metal building panel, the contours are best maintained if the flexible material is oriented sideways so that one of its side edges 24, 26 and the retainer portions 34, 36 first contact the molten zinc 38. In other embodiments, the contours may be best maintained if the flexible material is oriented relatively horizontally relative to the surface of the zinc 38 so that one of its faces first contacts the molten zinc.

The flexible material 44 is then removed from the bath of molten zinc 38 so that the zinc which adheres thereto can cool and harden to form the contoured metal building panel 10. Subsequent polishing, texturing, or other steps may also be performed on the panel to achieve a desired final appearance.

Figure 9:
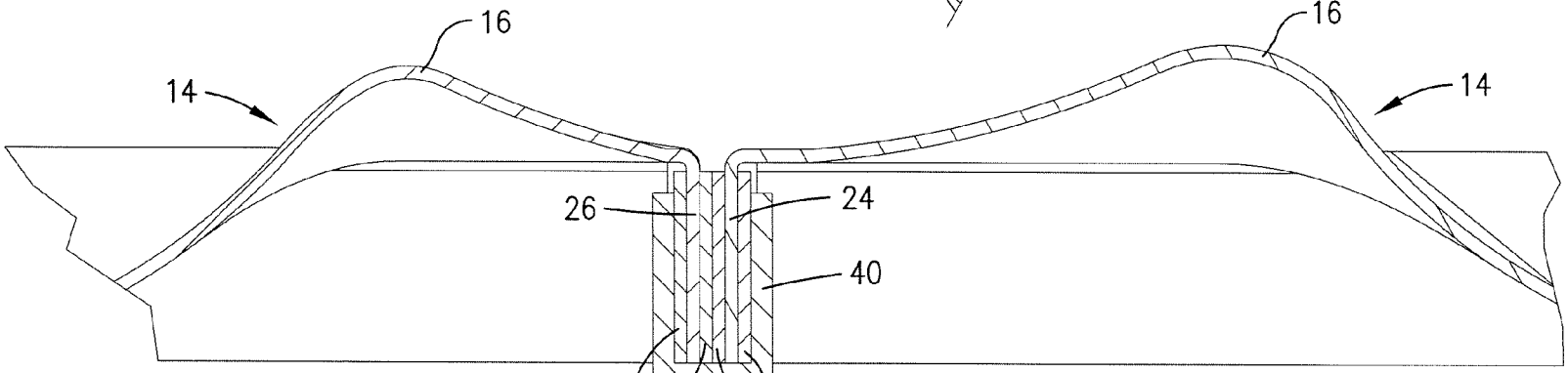
FIG. 9 is a horizontal sectional view taken along line 9-9 of FIG. 8.

FIGS. 8 and 9 illustrate how a number of the contoured metal building panels 10 may be joined and then secured to a building or other structure. The retainers of each contoured metal building panel may be attached to an underlying panel support structure, a portion of which is identified by numeral 40. An exemplary panel support structure is described in U.S. Pat. No. 7,210,273, incorporated in its entirety herein by reference.

The embodiments of the invention described above and other embodiments provide a contoured metal building panel with dramatic contours that cannot be created with conventional metal bending, finishing, and texturing techniques. The present invention therefore significantly expands the design options for metal building panels and allows artists, architects, and other persons to create buildings and other structures with truly unique appearances.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A method of forming a contoured metal building panel, the method comprising:

manipulating a piece of flexible material to create free-form contours in the material;

securing a plurality of edges of the flexible material to a frame-like structure;

applying molten metal to the flexible material while substantially maintaining the free-form contours in the flexible material; and securing the contoured metal building panel to a building to provide the building with a contoured surface, wherein the flexible material is a screen material or a screen wire material.

2. The method as set forth in claim 1, wherein the manipulating step is performed by a person.

3. The method as set forth in claim 1, wherein the applying step comprises dipping the flexible material in the molten metal.

4. The method as set forth in claim 3, wherein the dipping step further includes the step of orienting the flexible material relative to the molten metal so as to minimize flattening of the contours during the dipping step.

5. The method as set forth in claim 1, wherein the flexible material is fiberglass screen material, aluminum screen wire material, copper screen wire material, bronze screen wire material, stainless steel screen wire material, or galvanized steel screen wire material.

6. The method as set forth in claim 1, wherein the molten metal is molten zinc.

7. A method of forming a contoured metal building panel, the method comprising:

manipulating a piece of flexible material to create free-form contours in the material;

securing a plurality of edges of the flexible material to a frame-like structure;

applying molten metal to the flexible material by dipping the flexible material in molten metal while substantially maintaining the contours of in the flexible material by orienting the contours such that the length of the contours remains upright in the molten metal so as to minimize flattening of the contours during the dipping process without reinforcing the flexible material;

allowing the frame, the flexible mater, and the applied molten metal to cool and harden to form the contoured metal building panel; and securing the contoured metal building panel to a building to provide the building with a contoured surface, wherein the flexible material is a screen material or a screen wire material.

8. The method as set forth in claim 7, wherein the flexible material is fiberglass screen material, aluminum screen wire material, copper screen wire material, bronze screen wire material, stainless steel screen wire material, or galvanized steel screen wire material.

9. The method as set forth in claim 7, wherein the molten metal is molten zinc.

* * * * *